US012383798B2

(12) United States Patent
Kuntimaddi et al.

(10) Patent No.: US 12,383,798 B2
(45) Date of Patent: Aug. 12, 2025

(54) GOLF BALLS HAVING CHROMOGENIC POLYMERS IN ONE OR MORE LAYERS

(71) Applicant: Acushnet Company, Fairhaven, MA (US)

(72) Inventors: Manjari Kuntimaddi, Fairhaven, MA (US); Erin C. McDermott, Fairhaven, MA (US)

(73) Assignee: Acushnet Company, Fairhaven, MA (US)

( * ) Notice: Subject to any disclaimer, the term of this patent is extended or adjusted under 35 U.S.C. 154(b) by 77 days.

(21) Appl. No.: 18/081,228

(22) Filed: Dec. 14, 2022

(65) Prior Publication Data

US 2024/0198182 A1 Jun. 20, 2024

(51) Int. Cl.
*A63B 37/06* (2006.01)
*A63B 37/00* (2006.01)

(52) U.S. Cl.
CPC .. *A63B 37/00223* (2020.08); *A63B 37/00221* (2020.08); *A63B 37/00376* (2020.08); *A63B 37/0074* (2013.01); *A63B 37/0075* (2013.01); *A63B 37/0076* (2013.01)

(58) Field of Classification Search
CPC ..... A63B 37/00223; A63B 37/00373
See application file for complete search history.

(56) References Cited

U.S. PATENT DOCUMENTS

2004/0266553 A1* 12/2004 Park ..... A63B 37/00221 473/378
2009/0023518 A1* 1/2009 Lee ..... C09K 11/06 473/378
2013/0109505 A1* 5/2013 Wachi ..... A63B 43/008 427/157
2015/0045130 A1* 2/2015 Roach ..... A63B 60/02 473/226

* cited by examiner

*Primary Examiner* — Raeann Gorden
(74) *Attorney, Agent, or Firm* — Loeb & Loeb LLP

(57) ABSTRACT

A golf ball includes a core, a cover layer, and a chromogenic polymer incorporated into at least one of the cover layer or a coating layer applied to the cover layer. The chromogenic polymer causes the golf ball to exhibit a color-shift effect upon application of an external stimulus. The color-shift effect can be measured as a deltaE of greater than 2 when the external stimulus is within a target range. The external stimulus may be different depending on the type of chromogenic polymer, and, as a result, the target range depends on the type of external stimulus.

17 Claims, 2 Drawing Sheets

GOLF BALLS HAVING CHROMOGENIC POLYMERS IN ONE OR MORE LAYERS

FIELD OF THE INVENTION

The present disclosure relates generally to the field of golf balls, and more specifically to golf balls having one or more layers incorporating a chromogenic polymer that exhibits a color-shift effect upon application of a threshold external stimulus.

BACKGROUND OF THE INVENTION

The background description provided herein is for the purpose of generally presenting the context of the disclosure. The work of the presently named inventors, to the extent it is described in this background section, as well as aspects of the description that may not otherwise qualify as prior art at the time of filing, are neither expressly nor impliedly admitted as prior art against the present disclosure.

Both professional and amateur golfers use multi-piece, solid golf balls today. A two-piece solid golf ball generally includes a solid inner core protected by an outer cover. The inner core may be made of a natural or synthetic rubber such as polybutadiene, styrene butadiene, or polyisoprene. The cover surrounds the inner core and may be made of a variety of materials including ethylene acid copolymer ionomers, polyamides, polyesters, polyurethanes, and polyureas. Three-piece, four-piece, and even five-piece balls have also become popular over the years. Different materials are used in these golf ball constructions to impart specific properties and playing features to the ball, including the golf ball cover layer and any coating layers applied thereto. The appearance of the outer surfaces of the golf ball is also a relevant factor in selecting a golf ball for use and in golf ball performance, as golfers consider the functional advantages the visual appearance provides, such as in golf ball identification, alignment, visibility, visualization, or swing feedback.

Therefore, it would be desirable to have new, cost-effective, efficient methods that produce golf balls with desirable physical and playing performance properties, including those that have visual, chromogenic properties. The present disclosure also addresses the use of thin layer coatings and the application of one or more coatings imparting chromogenic properties to a golf ball.

SUMMARY OF THE INVENTION

In some embodiments, the present disclosure in includes a golf ball having a chromogenic polymer. The golf ball includes a core, a cover layer, and a chromogenic polymer incorporated into at least one of the cover layer or a coating layer applied to the cover layer. The chromogenic polymer causes the golf ball to exhibit a color-shift effect upon application of an external stimulus.

According to some embodiments, the color-shift effect can be measured as a deltaE of greater than 2 when the external stimulus is within a target range. Further, the target range depends on the type of external stimulus.

According to some embodiments, the chromogenic polymer is thermochromic and the external stimulus is a change in temperature.

According to some embodiments, the chromogenic polymer is mechanochromic or piezochromic and the external stimulus is a change in pressure.

According to some embodiments, the chromogenic polymer is electrochromic and the external stimulus is a change in voltage applied to the golf ball.

According to some embodiments, the chromogenic polymer is photochromic and the external stimulus is a change in exposure to light.

According to some embodiments, the chromogenic layer is the cover layer of the golf ball. In addition, the cover layer includes a thermoplastic polyurethane.

According to some embodiments, the chromogenic layer is the coating layer applied to the cover layer. In addition, the coating layer comprises isocyanate.

According to some embodiments, the color-shift effect comprises a shift between different opaque colors.

According to some embodiments, the color-shift effect comprises a shift between a transmissive state and opaque. The transmissive state is transparent and/or translucent.

According to some embodiments, the color-shift effect comprises a shift between a transmissive state and another transmissive state. The transmissive state may be transparent and the another transmissive state may be translucent.

In some embodiments, the present disclosure includes a golf ball having a chromogenic polymer in a cover layer. The golf ball includes a core, a cover layer, and a chromogenic polymer incorporated into at least one of the cover layer or a coating layer applied to the cover layer. The chromogenic polymer causes the golf ball to exhibit a color-shift effect upon application of pressure in the form of a strike by a golf club. Further, the color-shift effect can be measured as a deltaE of greater than 5 when the external stimulus is within a target range.

According to some embodiments, the color-shift effect is localized to a location on the golf ball at which the golf ball was struck by the golf club.

According to some embodiments, the color-shift effect comprises a change from a transmissive state to opaque.

According to some embodiments, the color-shift effect comprises a shift between different opaque colors.

In some other embodiments, a golf ball includes a chromogenic polymer in a coating layer. The golf ball includes a core, a cover layer, and a chromogenic coating layer applied to the cover layer. The chromogenic coating layer causes the golf ball to exhibit a color-shift effect upon application of an external stimulus.

According to some embodiments, the cover layer is at least one of transparent or translucent.

According to some embodiments, the cover layer is opaque.

BRIEF DESCRIPTION OF THE DRAWINGS

The foregoing and other aspects of the present invention are best understood from the following detailed description when read in connection with the accompanying drawings. For the purpose of illustrating the invention, there are shown in the drawings embodiments that are presently preferred, it being understood, however, that the invention is not limited to the specific instrumentalities disclosed. Included in the drawings are the following Figures.

DETAILED DESCRIPTION OF THE INVENTION

Figure 1:
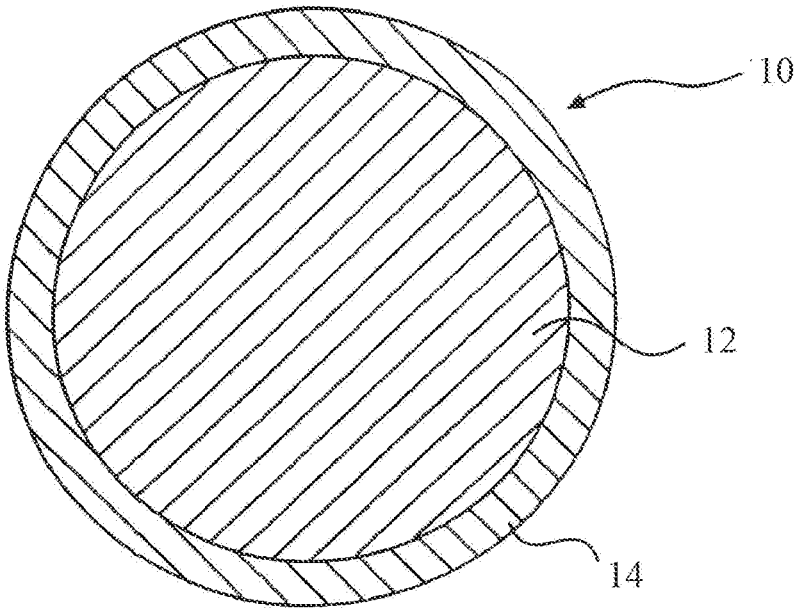
FIG. 1 is a cross-sectional view of a two-piece golf ball in accordance with an embodiment of the present disclosure.

The present disclosure generally relates to the use of chromogenic polymers in one or more layers of a golf ball. Chromogenic polymers are materials that change color based on an external stimulus, including but not limited to temperature, pressure, voltage or light. Chromogenic materials can be part of thermoplastic or thermoset compositions, including as polymer materials themselves or used as additives to other compositions. In an exemplary embodiment, one or more chromogenic materials is used in an outer cover layer and/or coating layer of a golf ball.

A golf ball including a chromogenic material incorporated into a cover layer or a coating layer includes unique properties such as a visible color shift based on the application of an external stimulus. A chromogenic material may be incorporated into the material of a cover layer such that the cover layer is comprised of a chromogenic polymer. In another example, a chromogenic polymer may be incorporated into a thin coating layer that is applied to the cover layer of the golf ball. In this instance, the golf ball may be said to include a chromogenic coating layer. In another example, a golf ball may include a cover layer and a coating layer that combined produce a chromogenic effect. In each of these examples, the golf ball is considered to have a chromogenic layer.

A chromogenic effect may include a visible color shift, including a transition of the appearance of the cover of the golf ball from one color to a perceptibly-different color. The color shift may also include transitions to and from transmissive states, such as transparent and translucent, transparent and opaque, and/or translucent and opaque. The resulting golf ball may include an integrated chromogenic effect that enhances one or more golf ball performance properties, such as identification, visibility, visualization, alignment, swing feedback, or the like.

Cover Layer

Golf balls consistent with the present disclosure include an outer cover layer. The outer cover layer includes at least one cover material. The cover material may be a thermoset polyurethane, a cast urethane, or an ionomer material.

In one embodiment, the cover is formed from a polyurethane, polyurea, or hybrid of polyurethane-polyurea. When used as cover layer materials, polyurethanes and polyureas can be thermoset or thermoplastic. Thermoset materials can be formed into golf ball layers by conventional casting or reaction injection molding techniques. Thermoplastic materials can be formed into golf ball layers by conventional compression or injection molding techniques.

In one example, the outer cover layer may be made of a thermoplastic polyurethane composition. In general, polyurethanes contain urethane linkages formed by reacting an isocyanate group (—N═C═O) with a hydroxyl group (OH). The polyurethanes are produced by the reaction of a multi-functional isocyanate (NCO R NCO) with a long-chain polyol having terminal hydroxyl groups (OH OH) in the presence of a catalyst and other additives. The chain length of the polyurethane prepolymer is extended by reacting it with short-chain diols (OH R' OH). The resulting polyurethane has elastomeric properties because of its "hard" and "soft" segments, which are covalently bonded together. This phase separation occurs because the mainly non-polar, low melting soft segments are incompatible with the polar, high melting hard segments. The hard segments, which are formed by the reaction of the diisocyanate and low molecular weight chain-extending diol, are relatively stiff and immobile. The soft segments, which are formed by the reaction of the diisocyanate and long chain diol, are relatively flexible and mobile. Because the hard segments are covalently coupled to the soft segments, they inhibit plastic flow of the polymer chains, thus creating elastomeric resiliency.

By the term, "isocyanate compound" as used herein, it is meant any aliphatic or aromatic isocyanate containing two or more isocyanate functional groups. The isocyanate compounds can be monomers or monomeric units, because they can be polymerized to produce polymeric isocyanates containing two or more monomeric isocyanate repeat units. The isocyanate compound may have any suitable backbone chain structure including saturated or unsaturated, and linear, branched, or cyclic. These isocyanate compounds also can be referred to as polyisocyanates or multi-functional isocyanates. By the term, "polyamine" as used herein, it is meant any aliphatic or aromatic compound containing two or more primary or secondary amine functional groups. The polyamine compound may have any suitable backbone chain structure including saturated or unsaturated, and linear, branched, or cyclic. The term "polyamine" may be used interchangeably with amine-terminated component. These polyamines also can be referred to as amine compounds or multi-functional amines. By the term, "polyol" as used herein, it is meant any aliphatic or aromatic compound containing two or more hydroxyl functional groups. The term "polyol" may be used interchangeably with hydroxy-terminated component. By the term, "polyimine compound", it is meant it is meant any aliphatic or aromatic compound containing two or more imine functional groups. These polyimines also can be referred to as imine compounds or multi-functional imines.

Thermoplastic polyurethanes have minimal cross-linking; any bonding in the polymer network is primarily through hydrogen bonding or other physical mechanism. Because of their lower level of cross-linking, thermoplastic polyurethanes are relatively flexible. The cross-linking bonds in thermoplastic polyurethanes can be reversibly broken by increasing temperature such as during molding or extrusion. That is, the thermoplastic material softens when exposed to heat and returns to its original condition when cooled. On the other hand, thermoset polyurethanes become irreversibly set when they are cured. The cross-linking bonds are irreversibly set and are not broken when exposed to heat. Thus, thermoset polyurethanes, which typically have a high level of cross-linking, are relatively rigid.

Commercially-available examples of suitable thermoplastic polyurethanes that can be used in accordance with this invention include TPUs sold under the tradenames of Texin® 250, Texin® 255, Texin® 260, Texin® 270, Texin®950U, Texin® 970U, Texin®1049, Texin®990DP7-1191, Texin® DP7-1202, Texin®990R, Texin®993, Texin®DP7-1049, Texin® 3203, Texin® 4203, Texin® 4206, Texin® 4210, Texin® 4215, and Texin® 3215, each commercially available from Covestro LLC, Pittsburgh PA; Estane® 50 DT3, Estane®58212, Estanc®55DT3, Estane®58887, EstaneREZ14-23A, EstaneRETE 50DT3, each commercially available from Lubrizol Company of Cleveland, Ohio; and Elastollan®WY1149, Elastollan®1154D53, Elastollan®1180A, Elastollan®1190A, Elastollan®1195A, Elastollan®1185AW, Elastollan®1175AW, each commercially available from BASF; Desmopan® 453, commercially available from Bayer of Pittsburgh, PA, and the E-Series TPUs, such as D 60 E 4024 commercially available from Huntsman Polyurethanes of Germany.

Aromatic polyurethanes can be prepared in accordance with this invention and these materials are preferably formed by reacting an aromatic diisocyanate with a polyol. Suitable aromatic diisocyanates that may be used in accordance with this invention include, for example, toluene 2,4-diisocyanate (TDI), toluene 2,6-diisocyanate (TDI), 4,4'-methylene diphenyl diisocyanate (MDI), 2,4'-methylene diphenyl diisocyanate (MDI), polymeric methylene diphenyl diisocyanate (PMDI), p-phenylene diisocyanate (PPDI), m-phenylene diisocyanate (PDI), naphthalene 1,5-diisocyanate (NDI), naphthalene 2,4-diisocyanate (NDI), p-xylene diisocyanate (XDI), and homopolymers and copolymers and blends thereof. The aromatic isocyanates are able to react with the hydroxyl or amine compounds and form a durable and tough polymer having a high melting point. The resulting polyurethane generally has good mechanical strength and cut/shear-resistance.

Aliphatic polyurethanes also can be prepared in accordance with this invention and these materials are preferably formed by reacting an aliphatic diisocyanate with a polyol. Suitable aliphatic diisocyanates that may be used in accordance with this invention include, for example, isophorone diisocyanate (IPDI), 1,6-hexamethylene diisocyanate (HDI), 4,4'-dicyclohexylmethane diisocyanate ("$H_{12}$ MDI"), meta-tetramethylxylyene diisocyanate (TMXDI), trans-cyclohexane diisocyanate (CHDI), and homopolymers and copolymers and blends thereof. Particularly suitable multifunctional isocyanates include trimers of HDI or $H_{12}$ MDI, oligomers, or other derivatives thereof. The resulting polyurethane generally has good light and thermal stability.

Any polyol available to one of ordinary skill in the art is suitable for use according to the invention. Exemplary polyols include, but are not limited to, polyether polyols, hydroxy-terminated polybutadiene (including partially/fully hydrogenated derivatives), polyester polyols, polycaprolactone polyols, and polycarbonate polyols. In one embodiment, the polyol includes polyether polyol. Examples include, but are not limited to, polytetramethylene ether glycol (PTMEG), polyethylene propylene glycol, polyoxypropylene glycol, and mixtures thereof. The hydrocarbon chain can have saturated or unsaturated bonds and substituted or unsubstituted aromatic and cyclic groups.

In another embodiment, polyester polyols are included in the polyurethane material. Suitable polyester polyols include, but are not limited to, polyethylene adipate glycol; polybutylene adipate glycol; polyethylene propylene adipate glycol; o-phthalate-1,6-hexanediol; poly(hexamethylene adipate) glycol; and mixtures thereof. The hydrocarbon chain can have saturated or unsaturated bonds, or substituted or unsubstituted aromatic and cyclic groups. In still another embodiment, polycaprolactone polyols are included in the materials of the invention. Suitable polycaprolactone polyols include, but are not limited to: 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and mixtures thereof. The hydrocarbon chain can have saturated or unsaturated bonds, or substituted or unsubstituted aromatic and cyclic groups. In yet another embodiment, polycarbonate polyols are included in the polyurethane material of the invention. Suitable polycarbonates include, but are not limited to, polyphthalate carbonate and poly(hexamethylene carbonate) glycol. The hydrocarbon chain can have saturated or unsaturated bonds, or substituted or unsubstituted aromatic and cyclic groups. In one embodiment, the molecular weight of the polyol is from about 200 to about 4000.

There are two basic techniques that can be used to make the polyurethanes: a) one-shot technique, and b) prepolymer technique. In the one-shot technique, the diisocyanate, polyol, and hydroxyl-terminated chain-extender (curing agent) are reacted in one step. On the other hand, the prepolymer technique involves a first reaction between the diisocyanate and polyol compounds to produce a polyurethane prepolymer, and a subsequent reaction between the prepolymer and hydroxyl-terminated chain-extender. As a result of the reaction between the isocyanate and polyol compounds, there will be some unreacted NCO groups in the polyurethane prepolymer. The prepolymer should have less than 14% unreacted NCO groups. Preferably, the prepolymer has no greater than 8.5% unreacted NCO groups, more preferably from 2.5% to 8%, and most preferably from 5.0% to 8.0% unreacted NCO groups. As the weight percent of unreacted isocyanate groups increases, the hardness of the composition also generally increases.

Either the one-shot or prepolymer method may be employed to produce the polyurethane compositions of the invention. In one embodiment, the one-shot method is used, wherein the isocyanate compound is added to a reaction vessel and then a curative mixture comprising the polyol and curing agent is added to the reaction vessel. The components are mixed together so that the molar ratio of isocyanate groups to hydroxyl groups is preferably in the range of about 1.00:1.00 to about 1.10:1.00. In a second embodiment, the prepolymer method is used. In general, the prepolymer technique provides better control of the chemical reaction. The prepolymer method provides a more homogeneous mixture resulting in a more consistent polymer composition. The one-shot method results in a mixture that is inhomogeneous (more random) and affords the manufacturer less control over the molecular structure of the resultant composition.

The polyurethane compositions can be formed by chain-extending the polyurethane prepolymer with a single chain-extender or blend of chain-extenders as described further below. As discussed above, the polyurethane prepolymer can be chain-extended by reacting it with a single chain-extender or blend of chain-extenders. In general, the prepolymer can be reacted with hydroxyl-terminated curing agents, amine-terminated curing agents, and mixtures thereof. The curing agents extend the chain length of the prepolymer and build-up its molecular weight. In general, thermoplastic polyurethane compositions are typically formed by reacting the isocyanate blend and polyols at a 1:1 stoichiometric ratio. Thermoset compositions, on the other hand, are cross-linked polymers and are typically produced from the reaction of the isocyanate blend and polyols at normally a 1.05:1 stoichiometric ratio A catalyst may be employed to promote the reaction between the isocyanate and polyol compounds for producing the prepolymer or between prepolymer and chain-extender during the chain-extending step. Preferably, the catalyst is added to the reactants before producing the prepolymer. Suitable catalysts include, but are not limited to, bismuth catalyst; zinc octoate; stannous octoate; tin catalysts such as bis-butyltin dilaurate, bis-butyltin diacetate, stannous octoate; tin (II) chloride, tin (IV) chloride, bis-butyltin dimethoxide, dimethyl-bis[1-oxonedecyl)oxy]stannane, di-n-octyltin bis-isooctyl mercaptoacetate; amine catalysts such as tricthylenediamine, triethylamine, and tributylamine; organic acids such as oleic acid and acetic acid; delayed catalysts; and mixtures thereof. The catalyst is preferably added in an amount sufficient to catalyze the reaction of the components in the reactive mixture. In one embodiment, the catalyst is present in an amount from about 0.001 percent to about 1 percent, and preferably 0.1 to 0.5 percent, by weight of the composition.

The hydroxyl chain-extending (curing) agents are preferably selected from the group consisting of ethylene glycol; diethylene glycol; polyethylene glycol; propylene glycol; 2-methyl-1,3-propanediol; 2-methyl-1,4-butanediol; monoethanolamine; diethanolamine; triethanolamine; monoisopropanolamine; diisopropanolamine; dipropylene glycol; polypropylene glycol; 1,2-butanediol; 1,3-butanediol; 1,4-butanediol; 2,3-butanediol; 2,3-dimethyl-2,3-butanediol; trimethylolpropane; cyclohexyldimethylol; triisopropanolamine; N,N,N',N'-tetra-(2-hydroxypropyl)-ethylene diamine; diethylene glycol bis-(aminopropyl) ether; 1,5-pentanediol; 1,6-hexanediol; 1,3-bis-(2-hydroxyethoxy) cyclohexane; 1,4-cyclohexyldimethylol; 1,3-bis-[2-(2-hydroxyethoxy) ethoxy]cyclohexane; 1,3-bis-{2-[2-(2-hydroxyethoxy) ethoxy]ethoxy}cyclohexane; trimethylolpropane; polytetramethylene ether glycol (PTMEG), preferably having a molecular weight from about 250 to about 3900; and mixtures thereof.

Suitable amine chain-extending (curing) agents that can be used in chain-extending the polyurethane prepolymer include, but are not limited to, unsaturated diamines such as 4,4'-diamino-diphenylmethane (i.e., 4,4'-methylene-dianiline or "MDA"), m-phenylenediamine, p-phenylenediamine, 1,2- or 1,4-bis(sec-butylamino)benzene, 3,5-diethyl-(2,4- or 2,6-) toluenediamine or "DETDA", 3,5-dimethylthio-(2,4- or 2,6-)toluenediamine, 3,5-diethylthio-(2,4- or 2,6-)toluenediamine, 3,3'-dimethyl-4,4'-diamino-diphenylmethane, 3,3'-diethyl-5,5'-dimethyl 4,4'-diamino-diphenylmethane (i.e., 4,4'-methylene-bis(2-ethyl-6-methyl-benezeneamine)), 3,3'-dichloro-4,4'-diamino-diphenylmethane (i.e., 4,4'-methylene-bis(2-chloroaniline) or "MOCA"), 3,3',5,5'-tetraethyl-4,4'-diamino-diphenylmethane (i.e., 4,4'-methylene-bis(2,6-diethylaniline), 2,2'-dichloro-3,3',5,5'-tetraethyl-4,4'-diamino-diphenylmethane (i.e., 4,4'-methylene-bis(3-chloro-2,6-diethyleneaniline) or "MCDEA"), 3,3'-diethyl-5,5'-dichloro-4,4'-diamino-diphenylmethane, or "MDEA"), 3,3'-dichloro-2,2',6,6'-tetraethyl-4,4'-diamino-diphenylmethane, 3,3'-dichloro-4,4'-diamino-diphenylmethane, 4,4'-methylene-bis(2,3-dichloroaniline) (i.e., 2,2',3,3'-tetrachloro-4,4'-diamino-diphenylmethane or "MDCA"); and mixtures thereof. One particularly suitable amine-terminated chain-extending agent is Ethacure 300™ (dimethylthiotoluenediamine or a mixture of 2,6-diamino-3,5-dimethylthiotoluene and 2,4-diamino-3,5-dimethylthiotoluene.) The amine curing agents used as chain extenders normally have a cyclic structure and a low molecular weight (250 or less).

When the polyurethane prepolymer is reacted with hydroxyl-terminated curing agents during the chain-extending step, as described above, the resulting polyurethane composition contains urethane linkages. On the other hand, when the polyurethane prepolymer is reacted with amine-terminated curing agents during the chain-extending step, any excess isocyanate groups in the prepolymer will react with the amine groups in the curing agent. The resulting polyurethane composition contains urethane and urea linkages and may be referred to as a polyurethane/urea hybrid. The concentration of urethane and urea linkages in the hybrid composition may vary. In general, the hybrid composition may contain a mixture of about 10 to 90% urethane and about 90 to 10% urea linkages.

More particularly, when the polyurethane prepolymer is reacted with hydroxyl-terminated curing agents during the chain-extending step, as described above, the resulting composition is essentially a pure polyurethane composition containing urethane linkages having the following general structure:

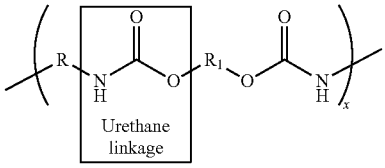

where x is the chain length, i.e., about 1 or greater, and R and $R_1$ are straight chain or branched hydrocarbon chain having about 1 to about 20 carbons.

However, when the polyurethane prepolymer is reacted with an amine-terminated curing agent during the chain-extending step, any excess isocyanate groups in the prepolymer will react with the amine groups in the curing agent and create urea linkages having the following general structure:

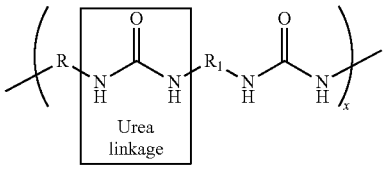

where x is the chain length, i.e., about 1 or greater, and R and $R_1$ are straight chain or branched hydrocarbon chain having about 1 to about 20 carbons.

The polyurethane compositions used to form the cover layer may contain other polymer materials including, for example: aliphatic or aromatic polyurethanes, aliphatic or aromatic polyureas, aliphatic or aromatic polyurethane/urea hybrids, olefin-based copolymer ionomer compositions, polyethylene, including, for example, low density polyethylene, linear low density polyethylene, and high density polyethylene; polypropylene; rubber-toughened olefin polymers; acid copolymers, for example, poly(meth)acrylic acid, which do not become part of an ionomeric copolymer; plastomers; flexomers; styrene/butadiene/styrene block copolymers; styrene/ethylene-butylene/styrene block copolymers; dynamically vulcanized elastomers; copolymers of ethylene and vinyl acetates; copolymers of ethylene and methyl acrylates; polyvinyl chloride resins; polyamides, poly(amide-ester) elastomers, and graft copolymers of ionomer and polyamide including, for example, Pebax® thermoplastic polyether block amides, available from Arkema Inc; cross-linked trans-polyisoprene and blends thereof; polyester-based thermoplastic elastomers, such as Hytrel®, available from DuPont; polyurethane-based thermoplastic elastomers, such as Elastollan®, available from BASF; polycarbonate/polyester blends such as Xylex®, available from SABIC Innovative Plastics; maleic anhydride-grafted polymers such as Fusabond®, available from DuPont; and mixtures of the foregoing materials.

In addition, the polyurethane compositions may contain fillers, additives, and other ingredients that do not detract from the properties of the final composition. These additional materials include, but are not limited to, catalysts, wetting agents, coloring agents, optical brighteners, cross-linking agents, whitening agents such as titanium dioxide and zinc oxide, ultraviolet (UV) light absorbers, hindered amine light stabilizers, defoaming agents, processing aids, surfactants, and other conventional additives. Other suitable additives include antioxidants, stabilizers, softening agents, plasticizers, including internal and external plasticizers, impact modifiers, foaming agents, density-adjusting fillers, reinforcing materials, compatibilizers, and the like. Some examples of useful fillers include zinc oxide, zinc sulfate, barium carbonate, barium sulfate, calcium oxide, calcium carbonate, clay, tungsten, tungsten carbide, silica, and mixtures thereof. Rubber regrind (recycled core material) and polymeric, ceramic, metal, and glass microspheres also may be used. Generally, the additives will be present in the composition in an amount between about 1 and about 70 weight percent based on total weight of the composition depending upon the desired properties.

Intermediate Layers

In one embodiment, an intermediate layer is disposed between the single or multi-layered core and surrounding cover layer. These intermediate layers also can be referred to as casing or mantle or inner cover layers. The intermediate layer can be formed from any materials known in the art, including thermoplastic and thermosetting materials, but preferably is formed of an ionomer composition comprising an ethylene acid copolymer containing acid groups that are at least partially neutralized. Suitable ethylene acid copolymers that may be used to form the intermediate layers are generally referred to as copolymers of ethylene; $C_3$ to $C_8$ α, β-ethylenically unsaturated mono- or dicarboxylic acid; and optional softening monomer. These ethylene acid copolymer ionomers also can be used to form the inner core and outer core layers as described above. In other embodiments, these thermoplastic ionomer compositions can be used to make the golf ball cover.

Suitable ionomer compositions include partially-neutralized ionomers and highly-neutralized ionomers (HNPs), including ionomers formed from blends of two or more partially-neutralized ionomers, blends of two or more highly-neutralized ionomers, and blends of one or more partially-neutralized ionomers with one or more highly-neutralized ionomers. For purposes of the present disclosure, "HNP" refers to an acid copolymer after at least 70% of all acid groups present in the composition are neutralized. Ionomers are salts of O/X- and O/X/Y-type acid copolymers, wherein O is an α-olefin, X is a $C_3$-$C_8$ α,β-ethylenically unsaturated carboxylic acid, and Y is a softening monomer. O is preferably selected from ethylene and propylene. X is preferably selected from methacrylic acid, acrylic acid, ethacrylic acid, crotonic acid, and itaconic acid. Methacrylic acid and acrylic acid are examples. Y is preferably selected from (meth) acrylate and alkyl (meth) acrylates wherein the alkyl groups have from 1 to 8 carbon atoms, including, but not limited to, n-butyl (meth) acrylate, isobutyl (meth) acrylate, methyl (meth) acrylate, and ethyl (meth) acrylate.

Some O/X and O/X/Y-type copolymers include, without limitation, ethylene acid copolymers, such as ethylene/(meth)acrylic acid, ethylene/(meth)acrylic acid/maleic anhydride, ethylene/(meth)acrylic acid/maleic acid mono-ester, ethylene/maleic acid, ethylene/maleic acid mono-ester, ethylene/(meth)acrylic acid/n-butyl (meth)acrylate, ethylene/(meth)acrylic acid/isobutyl (meth)acrylate, ethylene/(meth)acrylic acid/methyl (meth)acrylate, ethylene/(meth) acrylic acid/ethyl (meth)acrylate terpolymers, and the like. The term, "copolymer," as used herein, includes polymers having two types of monomers, those having three types of monomers, and those having more than three types of monomers. Some «, B-ethylenically unsaturated mono- or dicarboxylic acids are (meth) acrylic acid, ethacrylic acid, maleic acid, crotonic acid, fumaric acid, itaconic acid. As used herein, "(meth) acrylic acid" means methacrylic acid and/or acrylic acid. Likewise, "(meth) acrylate" means methacrylate and/or acrylate.

In one example, highly neutralized E/X- and E/X/Y-type acid copolymers, wherein E is ethylene, X is a $C_3$-$C_8$ α,β-ethylenically unsaturated carboxylic acid, and Y is a softening monomer are used. X is preferably selected from methacrylic acid, acrylic acid, ethacrylic acid, crotonic acid, and itaconic acid. Y is preferably an acrylate selected from alkyl acrylates and aryl acrylates and preferably selected from (meth) acrylate and alkyl (meth) acrylates wherein the alkyl groups have from 1 to 8 carbon atoms, including, but not limited to, n-butyl (meth) acrylate, isobutyl (meth) acrylate, methyl (meth) acrylate, and ethyl (meth) acrylate. Example E/X/Y-type copolymers are those wherein X is (meth) acrylic acid and/or Y is selected from (meth) acrylate, n-butyl (meth) acrylate, isobutyl (meth) acrylate, methyl (meth) acrylate, and ethyl (meth) acrylate. Other example E/X/Y-type copolymers are ethylene/(meth) acrylic acid/n-butyl acrylate, ethylene/(meth) acrylic acid/methyl acrylate, and ethylene/(meth) acrylic acid/ethyl acrylate.

The amount of ethylene in the acid copolymer is typically at least 15 wt. %, preferably at least 25 wt. %, more preferably least 40 wt. %, and even more preferably at least 60 wt. %, based on total weight of the copolymer. The amount of $C_3$ to $C_8$ α,β-ethylenically unsaturated mono- or dicarboxylic acid in the acid copolymer is typically from 1 wt. % to 35 wt. %, preferably from 5 wt. % to 30 wt. %, more preferably from 5 wt. % to 25 wt. %, and even more preferably from 10 wt. % to 20 wt. %, based on total weight of the copolymer. The amount of optional softening comonomer in the acid copolymer is typically from 0 wt. % to 50 wt. %, preferably from 5 wt. % to 40 wt. %, more preferably from 10 wt. % to 35 wt. %, and even more preferably from 20 wt. % to 30 wt. %, based on total weight of the copolymer. "Low acid" and "high acid" ionomeric polymers, as well as blends of such ionomers, may be used. In general, low acid ionomers are considered to be those containing 16 wt. % or less of acid moieties, whereas high acid ionomers are considered to be those containing greater than 16 wt. % of acid moieties.

The various O/X, E/X, O/X/Y, and E/X/Y-type copolymers are at least partially neutralized with a cation source, optionally in the presence of a high molecular weight organic acid, such as those disclosed in U.S. Pat. No. 6,756,436, the entire disclosure of which is hereby incorporated herein by reference. The acid copolymer can be reacted with the optional high molecular weight organic acid and the cation source simultaneously, or prior to the addition of the cation source. Suitable cation sources include, but are not limited to, metal ion sources, such as compounds of alkali metals, alkaline earth metals, transition metals, and rare earth elements; ammonium salts and monoamine salts; and combinations thereof. Some cation sources are compounds of magnesium, sodium, potassium, cesium, calcium, barium, manganese, copper, zinc, lead, tin, aluminum, nickel, chromium, lithium, and rare earth metals.

Other suitable thermoplastic polymers that may be used to form the intermediate layer include, but are not limited to, the following polymers (including homopolymers, copolymers, and derivatives thereof: (a) polyester, particularly those modified with a compatibilizing group such as sulfonate or phosphonate, including modified poly(ethylene terephthalate), modified poly(butylene terephthalate), modified poly(propylene terephthalate), modified poly(trimethylene terephthalate), modified poly(ethylene naphthenate), and those disclosed in U.S. Pat. Nos. 6,353,050, 6,274,298, and 6,001,930, the entire disclosures of which are hereby incorporated herein by reference, and blends of two or more thereof; (b) polyamides, polyamide-ethers, and polyamide-esters, and those disclosed in U.S. Pat. Nos. 6,187,864, 6,001,930, and 5,981,654, the entire disclosures of which are hereby incorporated herein by reference, and blends of two or more thereof; (c) polyurethanes, polyureas, polyurethane-polyurea hybrids, and blends of two or more thereof; (d) fluoropolymers, such as those disclosed in U.S. Pat. Nos. 5,691,066, 6,747,110 and 7,009,002, the entire disclosures of which are hereby incorporated herein by reference, and blends of two or more thereof; (e) polystyrenes, such as poly(styrene-co-maleic anhydride), acrylonitrile-butadiene-styrene, poly(styrene sulfonate), polyethylene styrene, and blends of two or more thereof; (f) polyvinyl chlorides and grafted polyvinyl chlorides, and blends of two or more thereof; (g) polycarbonates, blends of polycarbonate/acrylonitrile-butadiene-styrene, blends of polycarbonate/polyurethane, blends of polycarbonate/polyester, and blends of two or more thereof; (h) polyethers, such as polyarylene ethers, polyphenylene oxides, block copolymers of alkenyl aromatics with vinyl aromatics and polyamicesters, and blends of two or more thereof; (i) polyimides, polyetherketones, polyamideimides, and blends of two or more thereof; and (j) polycarbonate/polyester copolymers and blends.

Golf Ball Construction

The core layers for disclosed golf balls may be made using any suitable conventional technique such as, for example, compression or injection-molding. Typically, the cores are formed by compression molding a slug of uncured or lightly cured rubber material into a spherical structure. Prior to forming the cover layer, the core structure may be surface-treated to increase the adhesion between its outer surface and adjacent layer. Such surface-treatment may include mechanically or chemically-abrading the outer surface of the core. For example, the core may be subjected to corona-discharge, plasma-treatment, silane-dipping, or other treatment methods known to those in the art.

As discussed above, an inner cover layer or intermediate layer, preferably formed from an ethylene acid copolymer ionomer composition, can be formed between the core or ball sub-assembly and cover layer. The intermediate layer comprising the ionomer composition may be formed using a conventional technique such as, for example, compression or injection-molding. For example, the ionomer composition may be injection-molded or placed in a compression mold to produce half-shells. These shells are placed around the core in a compression mold, and the shells fuse together to form an intermediate layer. Alternatively, the ionomer composition is injection-molded directly onto the core using retractable pin injection-molding.

Figure 2:
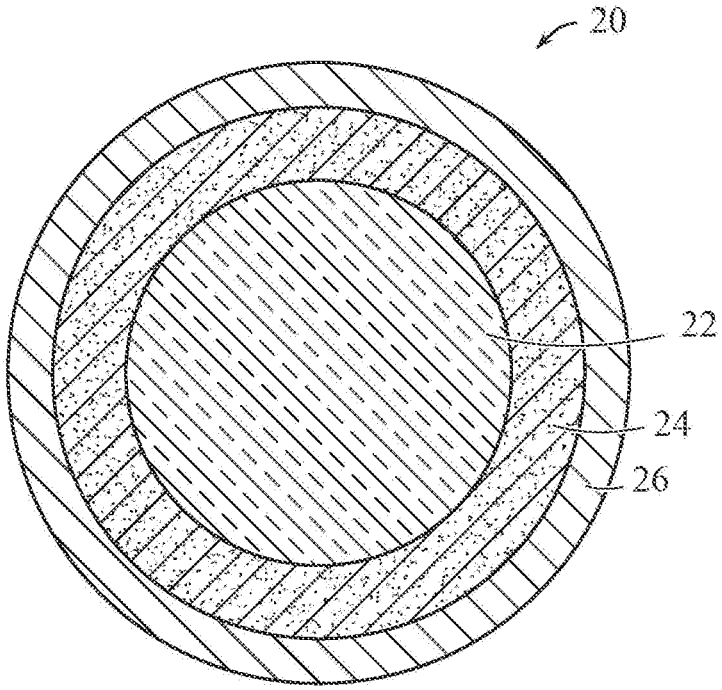
FIG. 2 is a cross-sectional view of a three-piece golf ball in accordance with an embodiment of the present disclosure.
Figure 3:
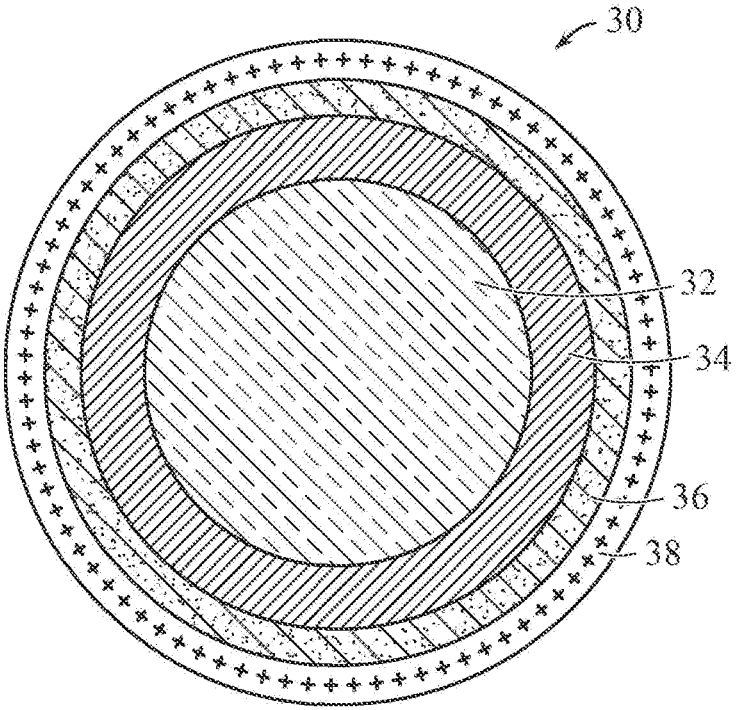
FIG. 3 is a cross-sectional view of a four-piece golf ball in accordance with an embodiment of the present disclosure.
Figure 4:
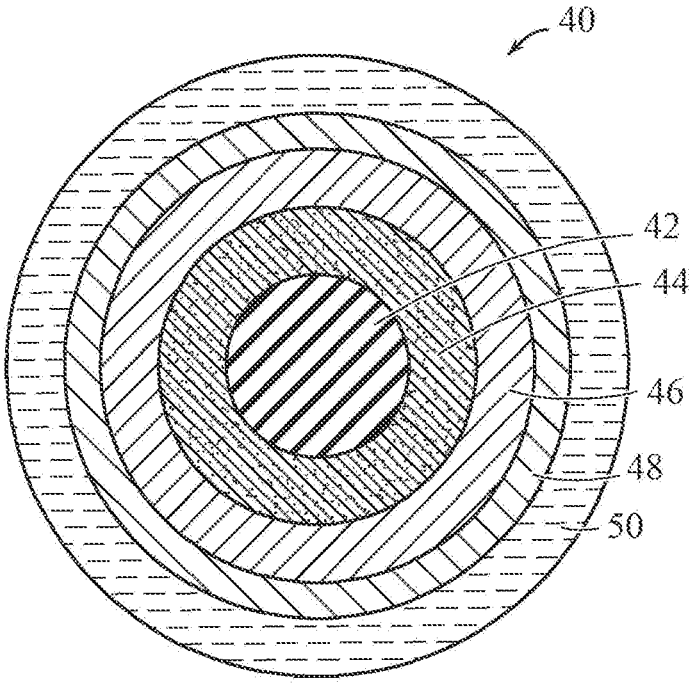
FIG. 4 is a cross-sectional view of a five-piece golf ball in accordance with an embodiment of the present disclosure.

In one embodiment, a golf ball of the present disclosure is a one-piece ball where the core and cover form a single integral layer. In another version, shown in FIG. 1, a golf ball of the present disclosure is a two-piece ball 10 comprising a single core layer 12 and a single cover layer 14. As shown in FIG. 2, in one embodiment, the golf ball 20 comprises a core layer 22, an intermediate layer 24, and a cover layer 26. In FIG. 2, the intermediate layer 24 can be considered an outer core layer, an inner cover layer, a mantle or casing layer, or any other layer disposed between the core 22 and the cover layer 26. Referring to FIG. 3, in another embodiment, a four-piece golf ball 30 comprises an inner core layer 32, an outer core layer 34, an intermediate layer 36, and an outer cover layer 38. In FIG. 3, the intermediate layer 36 may be considered a casing or mantle layer, or inner cover layer, or any other layer disposed between the outer core layer 34 and the outer cover of the ball 38. Referring to FIG. 4, in another version, a five-piece golf ball 40 comprises a three-layered core having an inner core layer 42, an intermediate core layer 44, an outer core layer 46, an inner cover layer 48, and an outer cover layer 50. As exemplified herein, a golf ball in accordance with the present disclosure can comprise any combination of any number of core layers, intermediate layers, and cover layers.

The golf balls of this invention provide the ball with a variety of advantageous mechanical and playing performance properties as discussed further below. In general, the hardness, diameter, and thickness of the different ball layers may vary depending upon the desired ball construction. If the ball includes an intermediate layer or inner cover layer, the hardness (material) is about 50 Shore D or greater, more preferably about 55 Shore D or greater, and most preferably about 60 Shore D or greater. In one embodiment, the inner cover has a Shore D hardness of about 62 to about 90 Shore D. In one example, the inner cover has a hardness of about 68 Shore D or greater. In addition, the thickness of the inner cover layer is preferably about 0.015 inches to about 0.100 inches, more preferably about 0.020 inches to about 0.080 inches, and most preferably about 0.030 inches to about 0.050 inches.

The manufacturing methods and molds of this invention may be used to mold relatively thin outer covers, for example covers having a thickness of less than 0.075 inches, more preferably 0.050 inches and below, preferably 0.040 inches and below, more preferably 0.030 inches and below, and most preferably 0.025 inches and below.

More particularly, the outer cover preferably has a thickness within a range having a lower limit of about 0.004 or 0.010 or 0.020 or 0.030 or 0.040 inches and an upper limit of about 0.050 or 0.055 or 0.065 or 0.070 or 0.080 inches. Most preferably, the thickness of the outer cover is about 0.025 inches or less. The outer cover preferably has a surface hardness of 65 Shore D or less, or 55 Shore D or less, or 50 Shore D or less, or 50 Shore D or less, or 45 Shore D or less. Preferably, the outer cover has hardness in the range of about 20 to about 59 Shore D. In one example, the outer cover has hardness in the range of about 25 to about 55 Shore D.

The United States Golf Association ("USGA") has set total weight limits for golf balls. Particularly, the USGA has established a maximum weight of 45.93 g (1.62 ounces) for golf balls. There is no lower weight limit. In addition, the USGA requires that golf balls used in competition have a diameter of at least 1.68 inches. There is no upper limit so many golf balls have an overall diameter falling within the range of about 1.68 to about 1.80 inches. The golf ball diameter is preferably about 1.68 to 1.74 inches, more preferably about 1.68 to 1.70 inches. In accordance with the present invention, the weight, diameter, and thickness of the core and cover layers may be adjusted, as needed, so the ball meets USGA specifications of a maximum weight of 1.62 ounces and a minimum diameter of at least 1.68 inches.

Chromogenic Polymer Layer

A chromogenic material is a material that exhibits a change in visible optical properties caused by an external stimulus. Chromogenic polymers include but are not limited to thermochromic polymers (external stimulus is temperature), mechanochromic or piezochromic polymers (external stimulus is pressure), electrochromic polymers (external stimulus is voltage), and photochromic polymers (external stimulus is light exposure). Disclosed embodiments include chromogenic cover compositions for golf balls and/or chromogenic coatings.

An embodiment of the present disclosure includes a coated or uncoated golf ball including a single- or dual-core and a cover layer formed from a chromogenic polymer. In another embodiment, a golf ball includes a cover layer and at least one coating layer applied to the cover layer, the coating layer including a chromogenic polymer.

According to a disclosed embodiment, a golf ball having at least one chromogenic polymer layer experiences a threshold color-shift effect upon application of an external stimulus within a target range. A threshold color-shift effect may be quantified using colorimetry. Colorimetry measurements may include, for example, spectral measurements (e.g., the appearance of a color through a light measurement), kinetic measurements (e.g., a determination of a halftime of color change in a manner known in the art), or other quality measurements. In some embodiments, colorimetry measurements may use a color coordinate system, such as those known in relation to the CIELAB color space (e.g., L*, a*, b*, C* and h°). A change in color may be understood as a threshold deviation in a color coordinate (e.g., average deltas (change in) lightness (DeltaL*cmc), chroma (DeltaC*cmc), hue (deltaH*cmc) and "distance" between two colors (DeltaE*cmc) may be derived using color coordinate measurements. For example, a color-shift may be considered to exceed a threshold when a deltaE*cmc (referred to herein as deltaE) measurement exceeds a predetermined threshold.

In some embodiments, a predetermined threshold color shift occurs when deltaE exceeds 1 (considered to be a color change upon close inspection). In other embodiments, a threshold color shift occurs when deltaE exceeds 2 (considered to be a color change perceptible at a glance). In other embodiments, a threshold color shift occurs when deltaE exceeds 10 (colors are clearly and quickly differentiated as observed).

In some embodiments, a predetermined threshold for a color shift may depend on the type of external stimulus that causes the color shift. For example, a color shift threshold for a change based on temperature may be different than a color shift threshold for a change based on pressure. For each external stimulus, there is a target range for producing the threshold color shift. In other words, a golf ball including a chromogenic polymer layer exhibits a chromogenic effect when the golf ball experiences an external stimulus within a target range (for that stimulus) and, as a result, produces a color shift that exceeds a threshold for that target range. For example, a thermochromic polymer layer in a golf ball may exhibit a color shift if a change in temperature of 5° F. produces a deltaE color shift of at least 2. In another example, a mechanochromic polymer layer in a golf ball may exhibit a color shift if a change in pressure of 1 Bar produces a deltaE color shift of at least 10.

Disclosed embodiments may include color-shift effects that are localized to an area of a golf ball layer that receives an external stimulus. For example, upon application of pressure in the form of a strike of a golf club during the course of a golf swing, only a portion of the golf ball that is hit by the golf club may exhibit the color-shift effects. This effect may advantageously enable a golfer to observe the location that the golf ball was struck by the golf club. In other embodiments, the color-shift effect may spread to the entire chromogenic layer. For instance, a golfer may strike a golf ball, causing the entire golf ball to change colors.

Embodiments of the present disclosure may include a cover layer comprising a chromogenic polymer. The cover material, in addition to being characterized as a chromogenic polymer, may be a thermoset polyurethane, a cast urethane, or an ionomer material. The cover material may be configured to perform a color shift. In one example, the color shift may be characterized as a shift between opaque colors (e.g., white to black, yellow or orange to red, white to yellow, yellow to black, etc.). In another example, a cover material may be configured to perform a color shift between a transmissive state (transparent/translucent) and opaque (white, yellow, blue, etc.). In another example, a cover material may be configured to perform a color shift between a transmissive state (transparent/translucent) and another transmissive state (transparent/translucent). The term color shift includes a shift between states that may be characterized as having an absence of color (e.g., white, transparent, translucent white, etc.).

In another embodiment, a golf ball includes a coating layer containing a chromogenic polymer. The golf ball may further include a cover layer beneath the chromogenic coating layer. The cover layer may be white or non-white. The cover layer may be transparent, translucent, or opaque, independent of the chromogenic effect of the coating layer. The chromogenic coating layer may contribute to the appearance of the golf ball. The color-shift effect produced by the chromogenic coating may combine with the color and/or appearance of the underlying cover layer to produce a combined visual effect. For example, the chromogenic coating may color shift from a first color to a second color, that, combined with the underlying coating layer, produces a third color. The chromogenic coating layer may include an isocyanate. The chromogenic coating layer may produce a color shift upon application of an external stimulus, consistent with the disclosed embodiments.

A chromogenic polymer for use in a golf ball may be selected from one or more known chromogenic compositions. Examples of chromogenic materials are described in a publication entitled "First example of non-toxic thermochromic polymer material—based on a novel mechanism," by Seeboth et al., and a publication entitled "Thermochromic Polymers—Function by Design," also by Seeboth et al., both of which are appended to this application and hereby incorporated by reference in their entirety.

Chromogenic polymers of the present disclosure may include one or more of the following chemical compositions that may contribute to a chromogenic effect: poly(lactic acid) (PLA); polystyrene (PS); poly(N-isopropylacrylamide) (PNIPAM); polyether; poly(ethylene terephthalate glycol); poly(ethylene terephthalate); poly(methyl methacrylate); poly(methylmethacrylate-co-butylmethacrylate); poly (butyl methacrylate); poly(ethylene-co-norbornene); poly (cthylene glycol) (PEG); poly(methylmethacrylate) (PMMA); poly(methacrylic acid); poly(ethylacrylate); poly (N,N-diethylacrylamide); poly[styrene-block-poly(methacrylic acid); poly(styrene-b-isoprene) (PS-b-PI); poly(dodecylglyceryl itaconate) (PDGI); poly(acrylamide) (PAAm); poly(acrylic acid) (PAAc); poly(p-methyl styrene) (PpMS); poly(N-isopropylacrylamide-co-acrylic acid) (PNIPAM-co-PAAc); poly(N-isopropylacrylamide-co-glycidylmethacrylate) (PNIPAM-co-PGMA); poly(N,N-diethylacrylamide-co-N-ethylacrylamide-co-2-hydroxyethyl methacrylate; poly(N-isopropylacrylamide-co-acrylic acid); N,N'-methylenebisacrylamide; poly(ethylene glycol) ethyl ether methacrylate; poly(ethylene glycol) methyl ether methacrylate; poly(benzylmethacrylate) (PBMA); 4-acryloylaminoazobenzene; N-isopropyl-acrylamide; Nafion (a perfluorosulfonate ion exchange polymer); safranin-O; phenolphthalein; methylene blue; borax; poly(l-vinyl-3-ethylimidazolium)bis-(trifluoromethanesulfonimide); N-isopropylacrylamide; glycidyl methacrylate; N,N'-methylene-bis-acrylamide; cresol red-3-(N,N-dimethyl-N-dodecylammonio) propanesulfonate; 1,4-bis(α-cyano-4-octadecyloxystyryl)-2,5-dimethoxybenzene (Cyano OPV I); 2-(4-[2-(4-ethoxy-phenyl)-vinyl]-phenyl)-3-(4-(2-(4-[2-(4-cthoxy-phenyl)-vinyl]-phenyl)-2-isocyano-vinyl)-2,5-bis-octyloxy-phenyl]-acrylonitrile (Cyano OPV II); 1,4-bis(α-cyano-4-methoxystyryl)-benzene (Cyano OPV III); 4,4'-bis (2-benzoxazolyl)stilbene (BBS); N,N'-bis(2-(1-piperazino) ethyl]-3,4,9,10-perylenetetracarboxylic acid diimide dichloride (PZPER); N,N'-bis-(R)-(1-phenylethyl)-perylene-3,4,9,10-tetracarboxyldiimide (R-Pery); anthocyanidin; cyanidin; pelargonidin chloride; cyanidin chloride; delphinidin chloride; dodecyl gallate; hexadecanoic acid; 5-methyl-2-[(2-nitrophenyl)amino]-3-thiophenecarbonitrile.

In one embodiment, a golf ball layer may include a chromogenic polymer having the following chemical composition: PLA; cyanidin chloride; dodecyl gallate; and hexadecanoic acid.

An embodiment of the present disclosure includes a coated golf ball including a single or dual core and a cover layer formed from a chromogenic thermoplastic polyurethane. The TPU cover has a first polyurethane coating layer and a second polyurethane coating layer disposed about the first polyurethane coating layer. In an embodiment, the first polyurethane coating layer includes unreacted isocyanate groups and has an isocyanate index of at least about 120. The first polyurethane coating layer has an isocyanate index of at least about 150, possibly, at least about 200, and most at least about 250.

The first polyurethane coating layer typically includes an aliphatic isocyanate and/or an aromatic isocyanate. One preferred isocyanate may be 4,4'-methylene diphenyl diisocyanate. If an aromatic and aliphatic isocyanate are present, the aromatic isocyanate and the aliphatic isocyanate are present in a ratio of about 2:1. The first and second polyurethane coating layers may be applied in a variety of manners know in the art, but are applied by spray-coating. In another preferred embodiment, the second polyurethane coating layer has an isocyanate index of less than about 96.

Another chromogenic polymer golf ball of the disclosure includes a core, a cover layer formed from a thermoplastic polyurethane, a first polyurethane coating layer including an aromatic isocyanate, and a second polyurethane coating layer disposed about the first polyurethane coating layer. The first polyurethane coating layer contains unreacted isocyanate groups and has an isocyanate index of at least about 120. The second polyurethane coating layer has an isocyanate index of less than about 96. The isocyanate comprises 4,4'-methylene diphenyl diisocyanate, 2,4'-methylene diphenyl diisocyanate, toluene 2,4-diisocyanate, toluene 2,6-diisocyanate, 4,4'-dicyclohexylmethane diisocyanate, p-phenylene diisocyanate, or isophorone diisocyanate. The first polyurethane coating layer may also be substantially free of aliphatic isocyanate.

Golf balls consistent with disclosed embodiments includes unique chromogenic polymers that produce color-shifting effects that may enhance a performance parameter of the golf ball, such as identification, alignment, visibility, swing feedback, etc. For example, a golf ball including a chromogenic polymer may exhibit a visible color-shift at a location of impact by a golf club, thereby providing a golfer with feedback on their swing and how the golf ball was struck. In another example, a golf ball may exhibit a color shift due to exposure to the sun (temperature and/or light), thereby making the golf ball more identifiable and/or findable during a round of play.

Unless otherwise defined, all terms (including technical and scientific terms) used herein have the same meaning as commonly understood by one of ordinary skill in the art of this disclosure. It will be further understood that terms, such as those defined in commonly used dictionaries, should be interpreted as having a meaning that is consistent with their meaning in the context of the specification and should not be interpreted in an idealized or overly formal sense unless expressly so defined herein. Well known functions or constructions may not be described in detail for brevity or clarity.

The terms "about" and "approximately" shall generally mean an acceptable degree of error or variation for the quantity measured given the nature or precision of the measurements. Numerical quantities given in this description are approximate unless stated otherwise, meaning that the term "about" or "approximately" can be inferred when not expressly stated.

The terminology used herein is for the purpose of describing particular embodiments only and is not intended to be limiting. As used herein, the singular forms "a", "an" and "the" are intended to include the plural forms as well (i.e., at least one of whatever the article modifies), unless the context clearly indicates otherwise.

The terms "first," "second," and the like are used to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the disclosure. Likewise, terms like "top" and "bottom"; "front" and "back"; and "left" and "right" are used to distinguish certain features or elements from each other, but it is expressly contemplated that a top could be a bottom, and vice versa.

The golf balls described and claimed herein are not to be limited in scope by the specific embodiments herein disclosed, since these embodiments are intended as illustrations of several aspects of the disclosure. Any equivalent embodiments are intended to be within the scope of this disclosure. Indeed, various modifications of the device in addition to those shown and described herein will become apparent to those skilled in the art from the foregoing description. Such modifications are also intended to fall within the scope of the appended claims. All patents and patent applications cited in the foregoing text are expressly incorporated herein by reference in their entirety. Any section headings herein are provided only for consistency with the suggestions of 37 C.F.R. § 1.77 or otherwise to provide organizational queues. These headings shall not limit or characterize the invention(s) set forth herein.

The invention claimed is:

1. A golf ball comprising:

a core;

a cover layer; and a chromogenic polymer incorporated into at least one of the cover layer or a coating layer applied to the cover layer;

wherein the chromogenic polymer causes the golf ball to exhibit a color-shift effect upon application of a change of pressure, wherein the color-shift effect can be measured as a deltaE of greater than 2 when the change of pressure is within a target range.

2. The golf ball of claim 1, wherein the chromogenic polymer is mechanochromic or piezochromic and wherein the color-shift effect can be measured as a deltaE of 10 or more when the change of pressure is within the target range.

3. The golf ball of claim 1, wherein the chromogenic layer is the cover layer of the golf ball, wherein the cover layer comprises a thermoplastic polyurethane.

4. The golf ball of claim 1, wherein the chromogenic polymer is incorporated into the coating layer applied to the cover layer, wherein the coating layer comprises isocyanate.

5. The golf ball of claim 1, wherein the color-shift effect comprises a shift between different opaque colors.

6. The golf ball of claim 1, wherein the color-shift effect comprises a shift between a transmissive state and opaque.

7. The golf ball of claim 6, wherein the transmissive state is transparent.

8. The golf ball of claim 6, wherein the transmissive state is translucent.

9. The golf ball of claim 1, wherein the color-shift effect comprises a shift between a transmissive state and another transmissive state.

10. The golf ball of claim 9, wherein the transmissive state is transparent and the another transmissive state is translucent.

11. A golf ball comprising:

a core;

a cover layer a chromogenic polymer incorporated into at least one of the cover layer or a coating layer applied to the cover layer;

wherein the chromogenic polymer causes the golf ball to exhibit a color-shift effect upon application of pressure in the form of a strike by a golf club, wherein the color-shift effect is localized to a location on the golf ball at which the golf ball is struck by a golf club and can be measured as a deltaE of greater than 5 when the application of pressure is within a target range.

12. The golf ball of claim 11, wherein the color-shift effect can be measured as a deltaE of at least 10 when the application of pressure is within the target range.

13. The golf ball of claim 12, wherein the color-shift effect comprises a change from a transmissive state to opaque.

14. The golf ball of claim 11, wherein the color-shift effect comprises a shift between different opaque colors.

15. A golf ball comprising:

a core;

a cover layer; and a chromogenic coating layer applied to the cover layer;

wherein the chromogenic coating layer causes the golf ball to exhibit a color-shift effect upon application of a change of pressure.

16. The golf ball of claim 15, wherein the cover layer is opaque.

17. The golf ball of claim 15, wherein the color-shift effect can be measured as a deltaE of at least 10 when the change of pressure is within a target range.

* * * * *